US008186416B2

(12) United States Patent
Kaneto et al.

(10) Patent No.: US 8,186,416 B2
(45) Date of Patent: May 29, 2012

(54) EQUIPMENT FOR MOLDING MOLD WITH MOLDING FLASK AND METHOD FOR MOLDING MOLD WITH MOLDING FLASK

(75) Inventors: Kimikazu Kaneto, Toyokawa (JP); Minoru Hirata, Toyokawa (JP); Mitsuyuki Matsushita, Toyokawa (JP)

(73) Assignee: Sintokogio, Ltd., Aichi (JP)

( * ) Notice: Subject to any disclaimer, the term of this patent is extended or adjusted under 35 U.S.C. 154(b) by 265 days.

(21) Appl. No.: 12/602,375

(22) PCT Filed: May 15, 2008

(86) PCT No.: PCT/JP2008/058922

§ 371 (c)(1),
(2), (4) Date: Nov. 30, 2009

(87) PCT Pub. No.: WO2008/149651

PCT Pub. Date: Dec. 11, 2008

(65) Prior Publication Data

US 2010/0193991 A1 Aug. 5, 2010

(30) Foreign Application Priority Data

Jun. 1, 2007 (JP) ..... 2007-146833
Dec. 21, 2007 (JP) ..... 2007-329574

(51) Int. Cl.
*B22C 25/00* (2006.01)
*B22C 15/28* (2006.01)

(52) U.S. Cl. ..... 164/18; 164/38; 164/194; 164/195

(58) Field of Classification Search ..... None
See application file for complete search history.

(56) References Cited

U.S. PATENT DOCUMENTS

| | | | | |
|---|---|---|---|---|
| 5,040,587 | A | 8/1991 | Müller | |
| 5,127,816 | A | 7/1992 | Grolla | |
| 2002/0157800 | A1 * | 10/2002 | Kaneto et al. | 164/20 |
| 2005/0051293 | A1 * | 3/2005 | Kaneto et al. | 164/37 |

FOREIGN PATENT DOCUMENTS

| | | | |
|---|---|---|---|
| DE | 37 13937 | A1 | 11/1988 |
| JP | 59-058545 | | 4/1984 |
| JP | 77-232234 | A | 4/1984 |
| JP | 3-35842 | A | 2/1991 |
| JP | 2001-138010 | A | 5/2001 |
| JP | 2004-306143 | A | 11/2004 |

* cited by examiner

*Primary Examiner* — Mary F Theisen
(74) *Attorney, Agent, or Firm* — Finnegan, Henderson, Farabow, Garrett & Dunner, L.L.P.

(57) ABSTRACT

Equipment and a method, therefore, for molding a mold with a molding flask, having a device for introducing molding sand that introduces molding sand into a molding flask and a filling frame, using compressed air, the molding flask and the filling frame being mounted on a model plate in a superimposed state; a shielding device having a plurality of feet that can enter the filling frame and can be temporarily held at positions that are spaced apart at predetermined distances from a model part of the model plate, which model part faces the plurality of feet. The equipment further includes a squeezing device provided adjacent to the device for introducing molding sand, which squeezing device squeezes the molding sand in the molding flask and the filling frame, and a transfer device for carrying the model plate, the molding flask and the filling frame into and out of both the device for introducing molding sand and the squeezing device.

14 Claims, 14 Drawing Sheets

EQUIPMENT FOR MOLDING MOLD WITH MOLDING FLASK AND METHOD FOR MOLDING MOLD WITH MOLDING FLASK

RELATED APPLICATIONS

This application claims priority of Japanese Patent Applications No. 2007-146833 filed Jun. 1, 2007 and No. 2007-329574 filed Dec. 21, 2007, the contents of both of which are incorporated herein by reference.

FIELD OF THE INVENTION

The present invention is related to equipment for molding a mold with a molding flask and a method for molding a mold with a molding flask by using the equipment.

BACKGROUND OF THE INVENTION

Conventionally a method for molding a mold that comprises using a turn-table so as to mold the mold efficiently is well known wherein at one end of the turn-table molding sand is compressed and an upper mold and a lower mold are molded in turn, while at the other end of the turn-table the preparations for compression of molding sand, such as filling the molding sand into a molding flask are carried out (see, for example, Patent Documents 1 and 2). That is, as shown in claim 1 of Patent Document 1, the method for molding a mold by filling molding sand into a molding space formed by a molding flask, an attached filling frame and a model plate having a model, followed by compression of the molding sand on the model plate, is disclosed. The method comprises filling and compressing the molding sand spatially in a separate station whereby a desired amount of molding sand is filled in an auxiliary vessel at a filling station, which vessel is nearly equal in volume to the molding space and the bottom side of which is closed with the model plate that is provided with a model. Then the auxiliary vessel that is provided with the model plate and the model is transferred to a molding station, and the molding sand is pushed out from the auxiliary vessel to the molding space at the position where the model plate and the model in coordinated movement closes the bottom side of the molding space.

However, in that method for molding a mold, the molding sand is poured from a high position and is dropped on the model plate by the gravitational force. So, there are problems such as the wear of the model plate and that the molding sand cannot fill out the pockets of the molding space as desired, such that no mold that has uniform strength cannot be molded.

Further, there is a problem that productivity is not sufficiently high because aligning a means for compressing a mold with a space unit for molding a mold takes time.

Moreover, the method for molding a mold in this way is not supposed to use a sleeve. So, usually no sufficient space for setting the sleeve is available. If the sleeve were set, there would be another problem that the sleeve would likely move when molding sand were poured onto the model plate. Then this would cause a drop in productivity.

Patent Document 1: German Patent No. 3713937, FIG. 1

Patent Document 2: U.S. Pat. No. 5,127,816, FIG. 1

DISCLOSURE OF THE INVENTION

Problems to be Solved

In view of the above problems, the present invention has an objective to provide equipment for molding a mold with a molding flask and a method for molding a mold by using the equipment in which an auxiliary tool for molding a mold such as a sleeve can be readily set to a model plate, which equipment also can achieve high productivity, causing less abrasion of the model plate and which equipment can mold a mold with a molding flask, and has uniform strength.

Means to Solve Problems

To achieve the above objective, the equipment for molding a mold with a molding flask, of the present invention is characterized in that it comprises: a means for introducing molding sand that introduces molding sand into a molding flask and a filling frame, using compressed air, the molding flask and the filling frame being mounted on a model plate in a superimposed state; the means for introducing molding sand comprising a shielding means having a plurality of feet that can enter the filling frame and can be temporarily held individually at the positions that are at the predetermined distances apart from the model part of the model plate, which model part faces the plurality of feet. The equipment further comprises a squeezing means provided adjacent to the means for introducing molding sand, which squeezing means squeezes the molding sand in the molding flask, and the filling frame, and a transfer means for carrying the model plate, the molding flask and the filling frame into and out of both the means for introducing molding sand and the squeezing means.

The equipment thus constituted introduces the molding sand through the means for introducing molding sand into the molding flask and the filling frame that are mounted on the model plate in a superimposed state, then carries, by means of the transfer means, the molding flask, the filling frame and the model plate, into which flask, frame, and model plate the molding sand is introduced, to a position right below the squeezing means, and then squeezes by the squeezing means the molding sand in the molding flask and the filling frame. Before the molding sand is squeezed by the squeezing means, it can be pre-squeezed by the compressed air blown from a mechanism for blowing compressed air.

In the equipment for molding a mold of the present invention, the molding sand can efficiently be introduced in high density conditions into the molding flask and the filling frame that are mounted on the model plate in a superimposed state by having a means for fluidizing molding sand installed on the means for introducing molding sand, because the means for fluidizing molding sand fluidizes the molding sand by blowing compressed air.

Further, if the squeezing means is provided with squeezing feet, the molding sand can suitably be squeezed in such a way that the squeezed sand are formed corresponding to the shape of the model part of the model plate.

Further, auxiliary tools for molding a mold that can be set on the model plate, such as the sleeve, also include a chiller or an other auxiliary tool, other than molding sand, that is used for manufacturing composite materials for a casting. The sleeve is also called an exothermic sleeve, to which is added an exothermic agent to prevent a riser from solidifying earlier than molten metal. The temperature of such a sleeve rises quickly because it is heated by the heat generated from an exothermic reaction such as given by $2\ Al+Fe_2O_3=2Fe+Al_2O_3$, which heat minimizes a heat transfer from the riser, leading to the increase in the effect to be produced by the riser. In this case the quantity of the exothermic agent that is added accounts for 1%.

Further, a mold that has a finer surface can be produced if facing sand is introduced into the molding flask before the molding sand is introduced into the molding flask and the filling frame. Further, the molding sand that is introduced into the molding flask and the filling frame through the means for introducing molding sand can be pre-compressed by the means for introducing molding sand. Further, the molding sand can be pre-compressed by having the compressed air blown from the mechanism for blowing compressed air and injected into the molding sand before it is squeezed by the squeezing means.

Effect of the Invention

As seen from the explanation, the equipment for molding a mold with a molding flask of the present invention comprises:

a means for introducing molding sand that introduces molding sand into a molding flask and a filling frame, using compressed air, the molding flask and the filling frame being mounted on a model plate in a superimposed state, the means for introducing molding sand comprising a shielding means having a plurality of feet that can enter the filling frame and can be temporarily held individually at the positions that are at the predetermined distances apart from the model part of the model plate, which model part faces the plurality of feet. The equipment further comprises a squeezing means provided adjacent to the means for introducing molding sand, which squeezing means squeezes the molding sand in the molding flask and the filling frame, and a transfer means for carrying the model plate, the molding flask and filling frame into and out of both the means for introducing molding sand and the squeezing means, wherein when the molding sand is squeezed with a plurality of squeezing feet, the lower surface of the mold can be made flat by having the squeezing surfaces of all the squeezing feet recede finally to the same level as the surface of the mold, whereby the equipment can easily have the auxiliary tool for molding mold, such as a sleeve, set to the model plate, and can achieve high productivity, causing less abrasion of the model plate, and produces superior effects, such as being able to mold a mold with a flask, which mold has uniform strength.

BRIEF DESCRIPTION OF THE DRAWING

FIG. 4-B is an illustrative view of the operation of the equipment for molding a mold with a molding flask of FIG. 1.

FIG. 5-B is an illustrative view of the operation of the equipment for molding a mold with a molding flask of FIG. 1.

FIG. 6-B is an illustrative view of the operation of the equipment for molding a mold with a molding flask of FIG. 1.

FIG. 7-B is an illustrative view of the operation of the equipment for molding a mold with a molding flask of FIG. 1.

FIG. 8-B is an illustrative view of the operation of the equipment for molding a mold with a molding flask of FIG. 1.

FIG. 10-B is an illustrative view of the operation of the equipment for molding a mold with a molding flask of FIG. 9.

FIG. 11-B is an illustrative view of the operation of the equipment for molding a mold with a molding flask of FIG. 9.

FIG. 12-B is an illustrative view of the operation of the equipment for molding a mold with a molding flask of FIG. 9.

FIG. 13-B is an illustrative view of the operation of the equipment for molding a mold with a molding flask of FIG. 9.

FIG. 14-B is an illustrative view of the operation of the equipment for molding a mold with a molding flask of FIG. 9.

BEST EMBODIMENT FOR CARRYING OUT THE INVENTION

Figure 1:
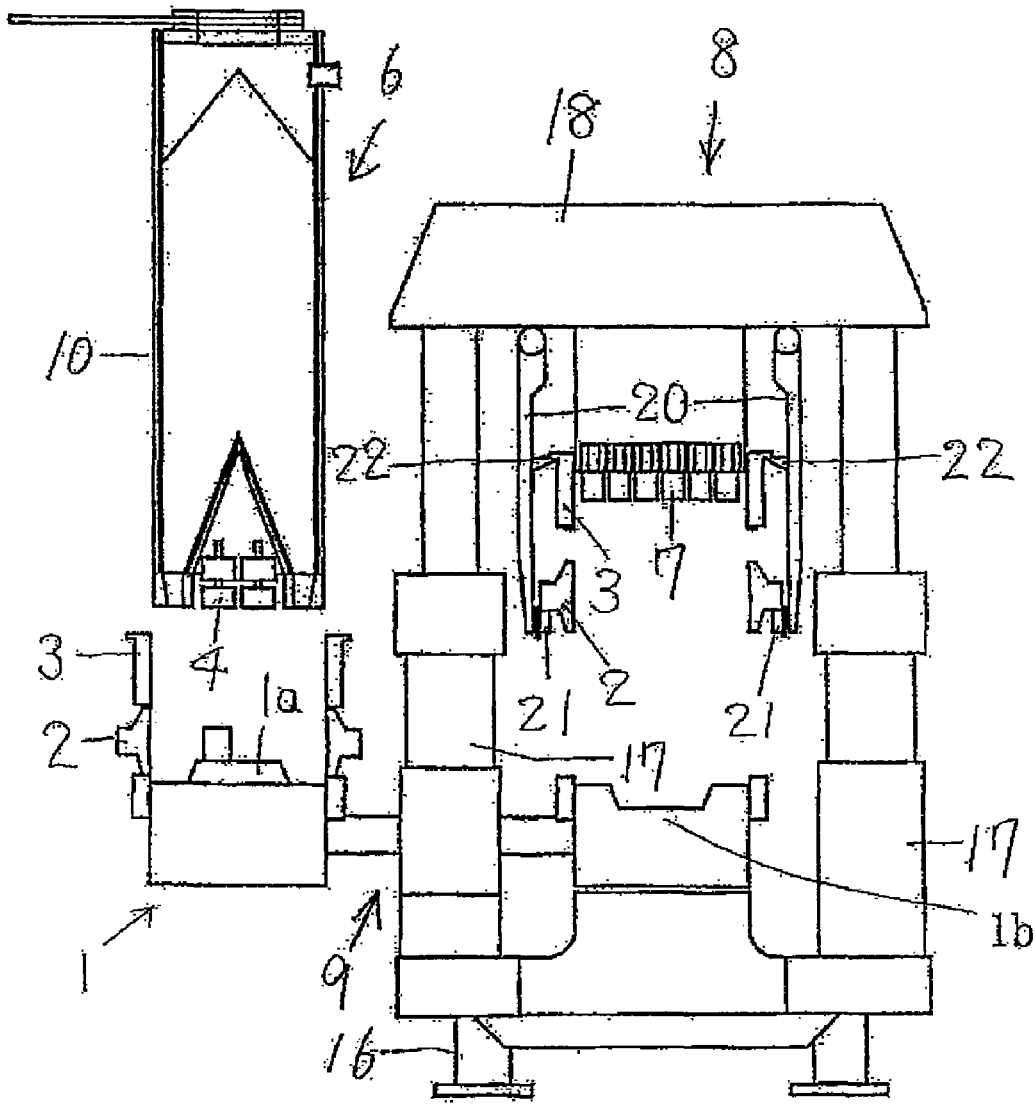
FIG. 1 is a front view of equipment for molding a mold with a molding flask of an embodiment of the present invention.
Figure 2:
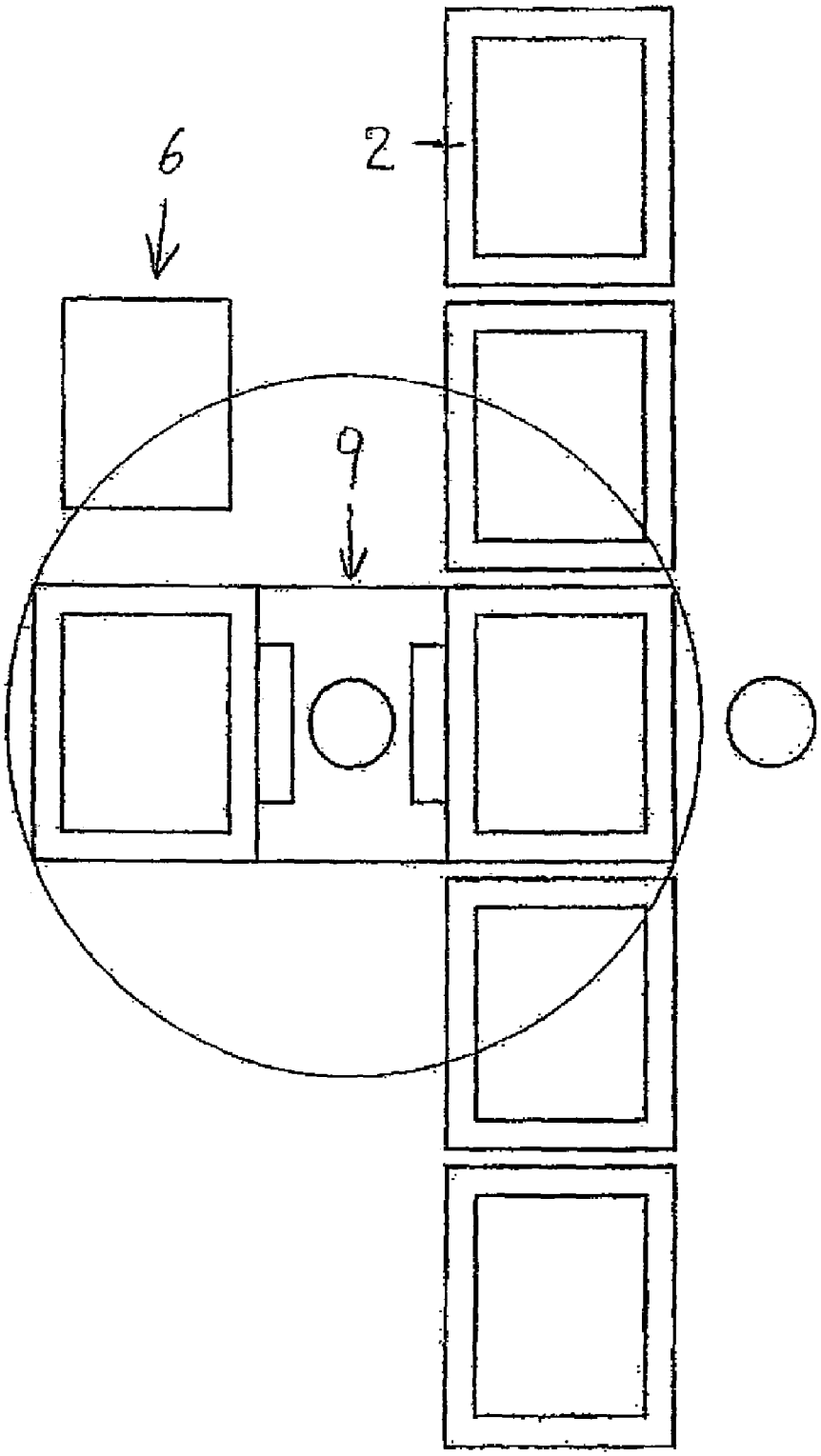
FIG. 2 is a schematic plan view of the equipment for molding a mold with a molding flask of FIG. 1.

Below an embodiment of the equipment for molding a mold with a molding flask, of the present invention is explained in detail based on FIGS. 1 to 8. As shown in FIGS. 1 and 2, the equipment for molding a mold with a molding flask, of the present invention comprises:

a means for introducing molding sand 6 that introduces molding sand into a molding flask 2 and a filling frame 3 using compressed air, the molding flask 2 and the filling frame 3 being mounted on a model plate 1 in a superimposed state, the means for introducing molding sand 6 comprising a shielding means 5 having a plurality of feet 4, which can enter the filling frame 3 and can be temporarily held individually at the positions that are at the predetermined distances apart from the model part of the model plate 1, which model part faces the plurality of feet. The equipment further comprises a squeezing means 8 that has a plurality of squeezing feet 7, the squeezing means 8 being provided adjacent to the means for introducing molding sand 6, which means squeezes the molding sand in the molding flask 2 and the filling frame 3, and a turntable 9, as a transfer means, for carrying the model plate 1, the molding flask 2 and filling frame 3 into and out of both the means for introducing molding sand 6 and the squeezing means 8.

Figure 3:
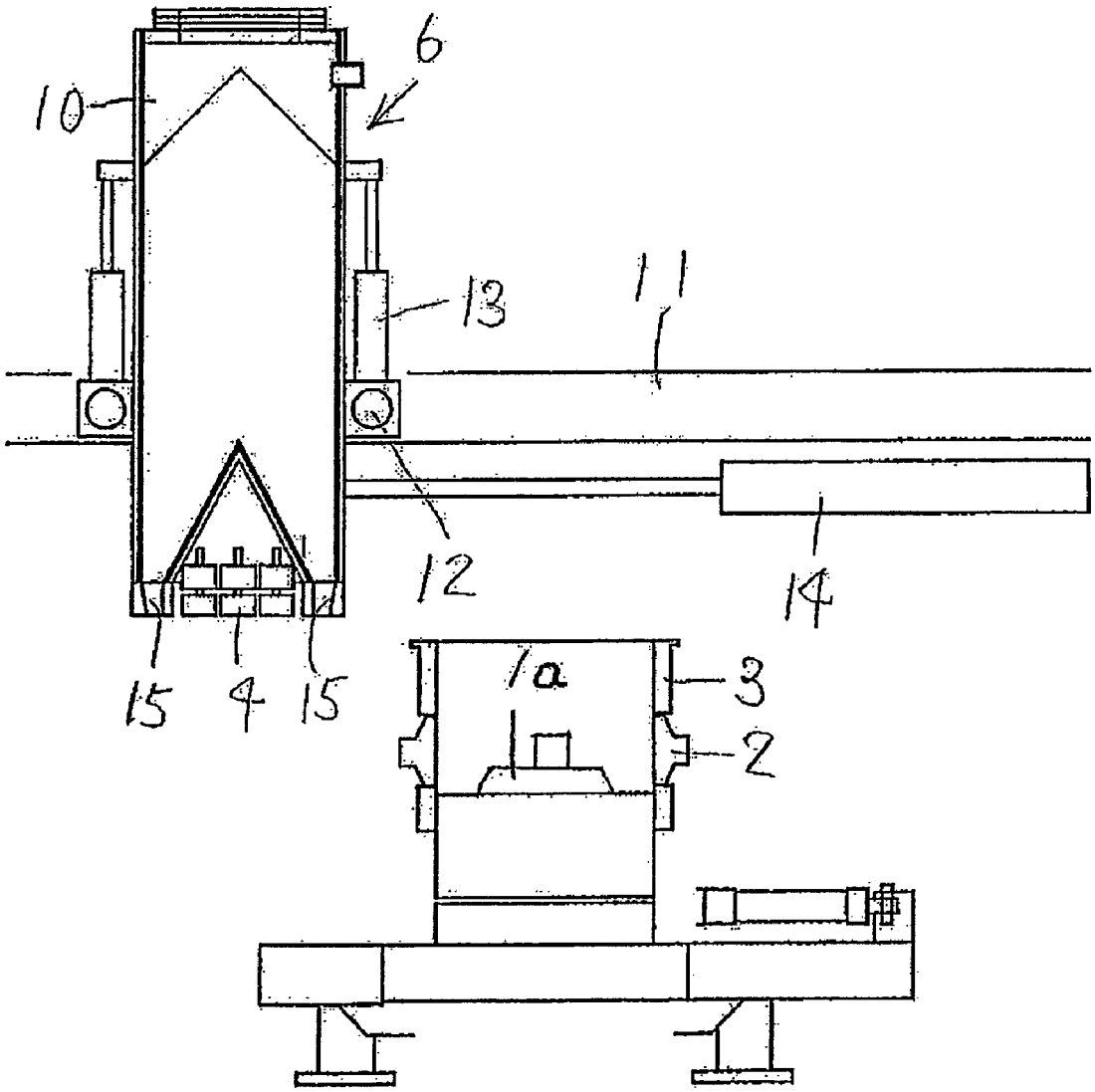
FIG. 3 is a left side-view of the equipment for molding a mold with a molding flask of FIG. 1.

The means for introducing molding sand 6 is provided with a means for fluidizing molding sand (not shown), which means fluidizes the molding sand by injecting compressed air. Further, as shown in FIG. 3, the means for introducing molding sand 6 comprises a sand tank 10 that stores the molding sand, the sand tank 10 being installed on a carriage 12 that can move to the left and right on rails 11, the tank 10 being supported by two first cylinders 13 facing upward and being movable up and down. To the carriage 12 is fastened the end tip of a piston rod of the second cylinder 14 that is disposed horizontally at fixed position, whereby the sand tank 10 and the carriage 12, etc., move into and out of the place right above the filling frame 3, which will be explained later, by the extension and contraction of the second cylinder 14. Further, the lower part of the sand tank 10 has a shape that forks into two branches and each branch of the folk has an outlet 15 for discharging molding sand at the lowest end. Further, a plurality of feet 4 are provided between these two outlets 15 for discharging molding sand.

Also, as shown in FIG. 1, the squeezing means 8 has, on a base plate 16, two horizontally aligned hydraulic cylinders 17, which face upward and which are positioned at a the predetermined distance apart between them. A ceiling frame 18 is placed across the upper ends of the piston rods of the two hydraulic cylinders 17. At the middle of the ceiling frame 18 is suspended a plurality of hydraulic cylinders (not shown) from the lower surface of the ceiling frame 18, which respective cylinders can adjust the vertical movements of a group of the plurality of squeezing feet 7. Further, on both left and right sides of the plurality of squeezing feet 7, a pair of roller frames 20 that can extend in the backward and forward directions are suspended at their upper ends and spaced apart at a predetermined distance in the left and right directions. The pair of roller frames 20 are rotatably held at their upper ends, and the distance between the pair of roller frames 20 is widened and closed by the extension and contraction of a cylinder (not shown).

A plurality of flanged rollers 21, which can move backward and forward the molding flask 2 that is placed on the flanged rollers 21, is disposed at the lower ends of and the inner sides of a pair of roller frames 20. The plurality of flanged rollers 21 are supported at the axes of the rollers and positioned in a row in the backward and the forward directions spaced apart from each other at a predetermined distance. Further hook members 22, on which the filling frame 3 is to be hooked, protrude at the inner sides and at the upper parts of the pair of the roller frames 20.

Also, the turntable 9 is disposed on the outer surface of the left hydraulic cylinder 17 of the two hydraulic cylinders 17, wherein the turntable can turn at 180 degrees on the horizontal level at certain intervals around the center of the turntable. The model plate 1*a* for molding the upper mold and the model plate 1*b* for molding the lower mold are loaded at the left side and right side ends of the turntable 9 respectively.

Figure 4:
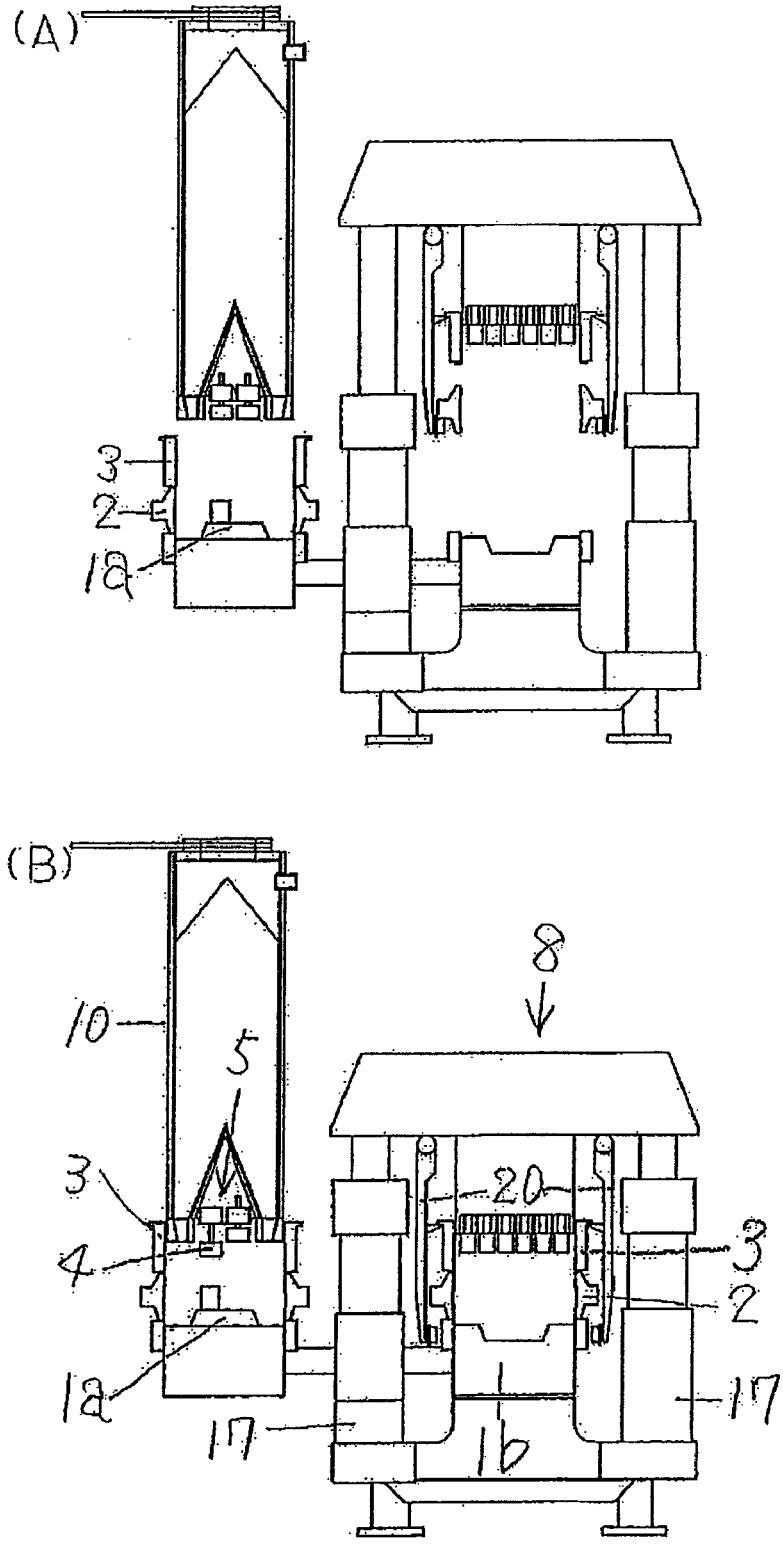
FIG. 4-A is an illustrative view of the equipment for molding a mold with a molding flask in operation of FIG. 1.

A process to mold a desired mold with a molding flask is explained, starting from the position that is shown in FIGS. 1 and 2. First, as shown in FIG. 4-A, the means for introducing molding sand 6 is carried by the carriage 12, which is driven by the extension and contraction of the second cylinder 14, to the position right above the molding flask 2 and the filling frame 3 that are mounted on the model plate 1*a* in a superimposed state. Next as shown in FIG. 4-B, the sand tank 10 is lowered by the contraction of two first cylinders 13 of the means for introducing molding sand 6, whereby the plurality of feet 4 of the shielding means 5 enters the filling frame 3 above the upper model plate 1*a*. At the same time the plurality of feet 4 is lifted and lowered so that it matches the position of the model part of the upper model plate 1*a*. Namely, the plurality of feet 4 is lifted or lowered so that the lower surfaces of the plurality of feet 4 are spaced apart at predetermined distances from the model part of the upper model plate 1*a*, which model part faces the lower surfaces of the plurality of feet 4. Thus the molding space is formed by the upper model plate 1*a*, the molding flask 2, the filling frame 3, and the plurality of feet 4.

The predetermined distances between the lower surfaces of the plurality of feet 4 and the model part of the upper model plate 1*a*, which model part faces the lower surfaces of the plurality of feet 4, are decided in such a way that where the height of the model part is greater, the amount of sand that is compressed so as to mold a mold is made smaller by having the feet 4 lowered and where the height of the model part is smaller, the amount of sand that is compressed is increased with the feet 4 being kept in a lifted position. In this way when the molding sand in the molding space is squeezed with the plurality of squeezing feet 7 of the squeezing means 8, all the surfaces of the squeezing feet 7 finally recede to nearly the same level as that of the surface of the molding flask 2.

Also, as shown in FIG. 4-B, the molding flask 2 and the filling frame 3 disposed in the squeezing means 8 are lowered via the ceiling frame 18 and placed on a lower model plate 1*b*, by two hydraulic cylinders 17 of the squeezing means 8 being contracted.

Figure 5:
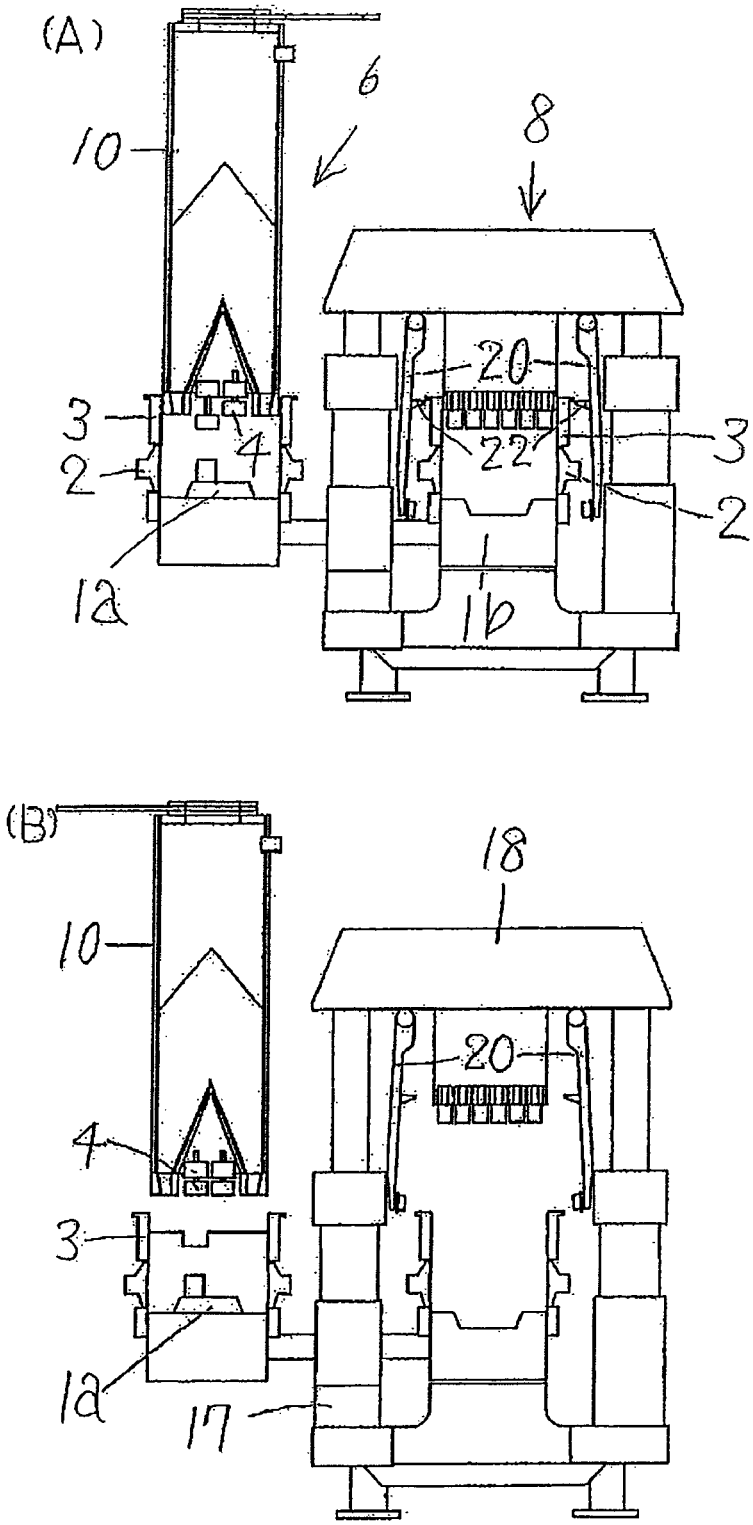
FIG. 5-A is an illustrative view of the equipment for molding a mold with a molding flask in operation of FIG. 1.

Then, as shown in FIG. 5-A, facing sand is introduced onto the upper model plate 1*a*. Then while the molding sand in the sand tank 10 is being fluidized by the compressed air that is injected from the means for fluidizing molding sand of the means for introducing molding sand 6, the molding sand is introduced into the molding flask 2 and the filling frame 3 that are above the upper model plate 1*a* by the compressed air being supplied to the upper surface of the molding sand in the sand tank 10. Then the molding sand in the molding flask 2 and the filling frame 3 *b* is pre-compressed by the sand tank 10 and the plurality of feet 4, etc., being lowered by the first two hydraulic cylinders 13 further contracted. In parallel two hook members 22 for the filling frame are separated from the filling frame 3 of the lower model plate 1*b* by the distance being increased between each frame of the pair of roller frames 20 of the squeezing means 8. Then, as shown in FIG. 5-B, while the plurality of feet 4 is separated from the filling frame 3 that is above the upper model plate 1*a*, by the sand tank 10 being lifted by the extension of the two first hydraulic cylinders 13, the ceiling frame 18, the pair of roller frames 20, etc., are lifted by the two hydraulic cylinders 17 being extended.

Figure 6:
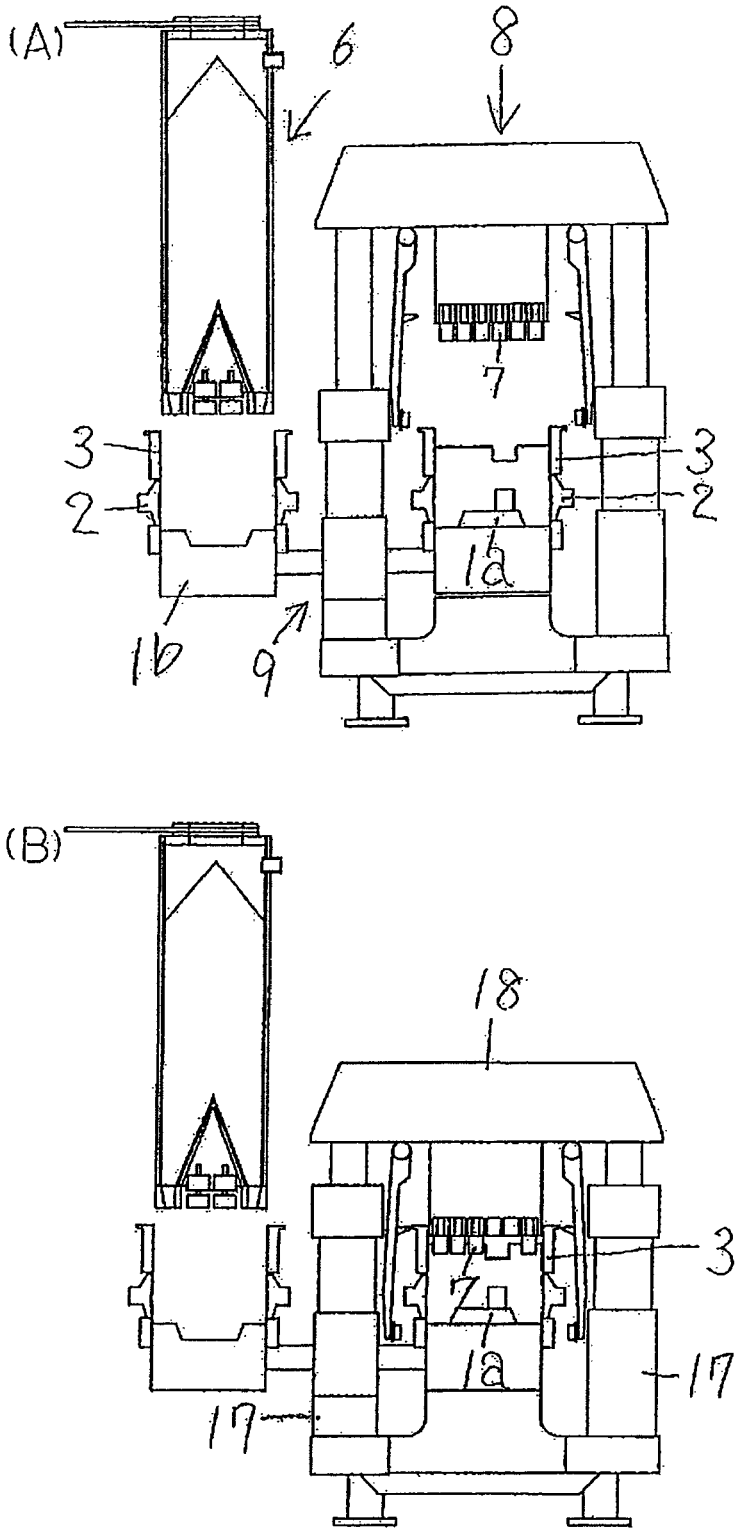
FIG. 6-A is an illustrative view of the equipment for molding a mold with a molding flask in operation of FIG. 1.

Next, as shown in FIG. 6-A, by means of the turntable 9, the upper model plate 1*a*, the molding flask 2 and the filling frame 3, etc., into which model plate, flask, and frame the molding sand has been introduced are transferred from the position right below the means for introducing molding sand 6 to the position right below the plurality of squeezing feet 7 of the squeezing means 8. Also the lower model plate 1*b*, the molding flask 2 and the filling frame 3, etc., are transferred from the position right below the plurality of squeezing feet 7 to the position right below the means for introducing molding sand 6. Then the plurality of squeezing feet 7 are preset by the plurality of squeezing feet 7 being lifted and lowered corresponding to the shape of the model part of the upper model plate 1*a*. Namely, the lower surfaces of the plurality of squeezing feet 7 are individually adjusted to keep the predetermined distances from the model part of the upper model plate 1*a*, facing the lower surface of the plurality of squeezing feet 7, by the plurality of squeezing feet 7 being lifted or lowered. The predetermined distances between the lower surfaces of the plurality of squeezing feet 7 and the model part of the upper model plate 1*a*, facing the lower surfaces of the plurality of squeezing feet 7, are determined in such a way that where the height of the model part is greater, the amount of sand that is compressed by the squeezing feet 7 is decreased accordingly and where the height of the model part is smaller, the amount of sand that is compressed is made greater holding the squeezing feet 7 in a lifted position.

Figure 7:
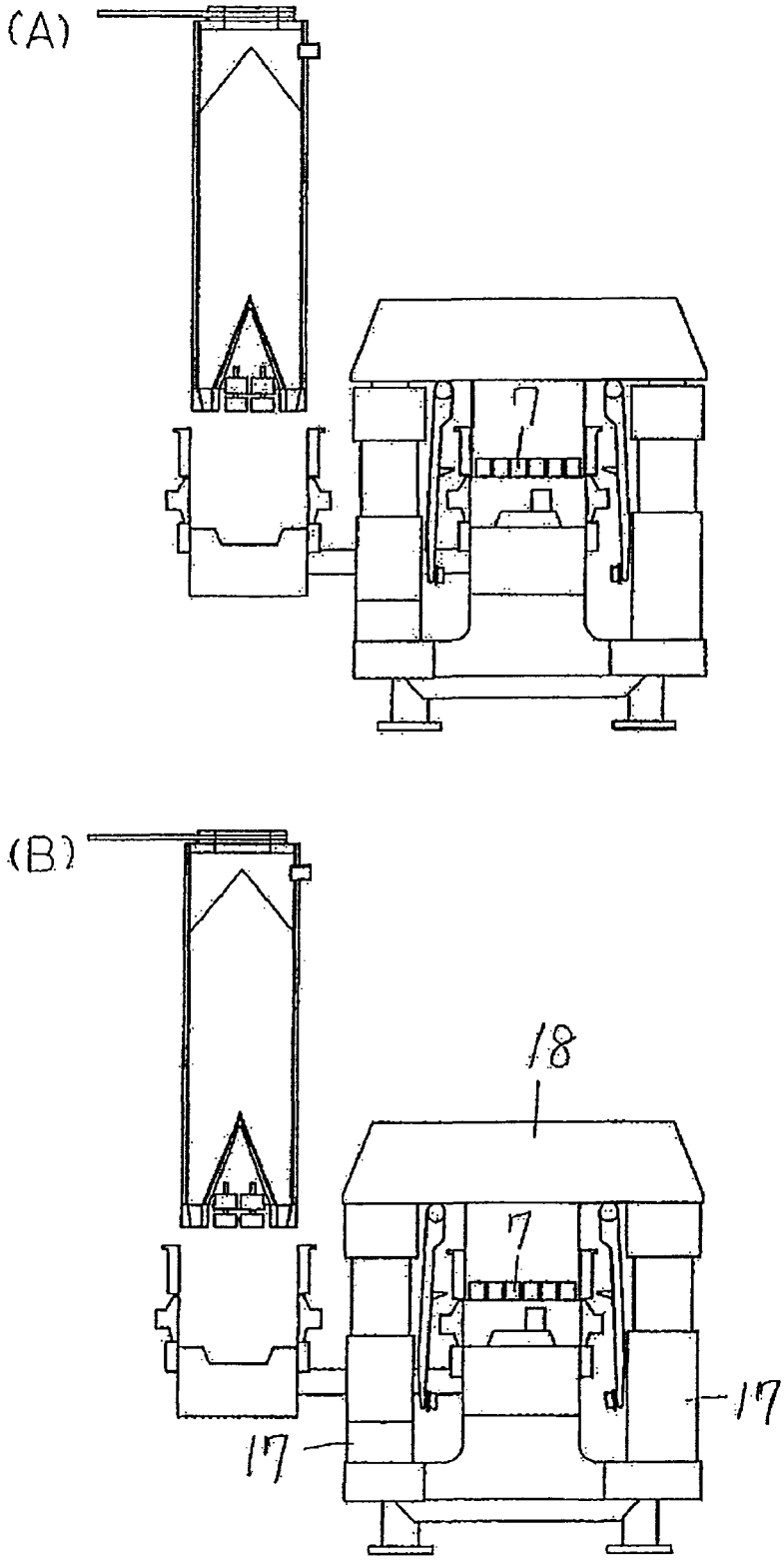
FIG. 7-A is an illustrative view of the equipment for molding a mold with a molding flask in operation of FIG. 1.
Figure 8:
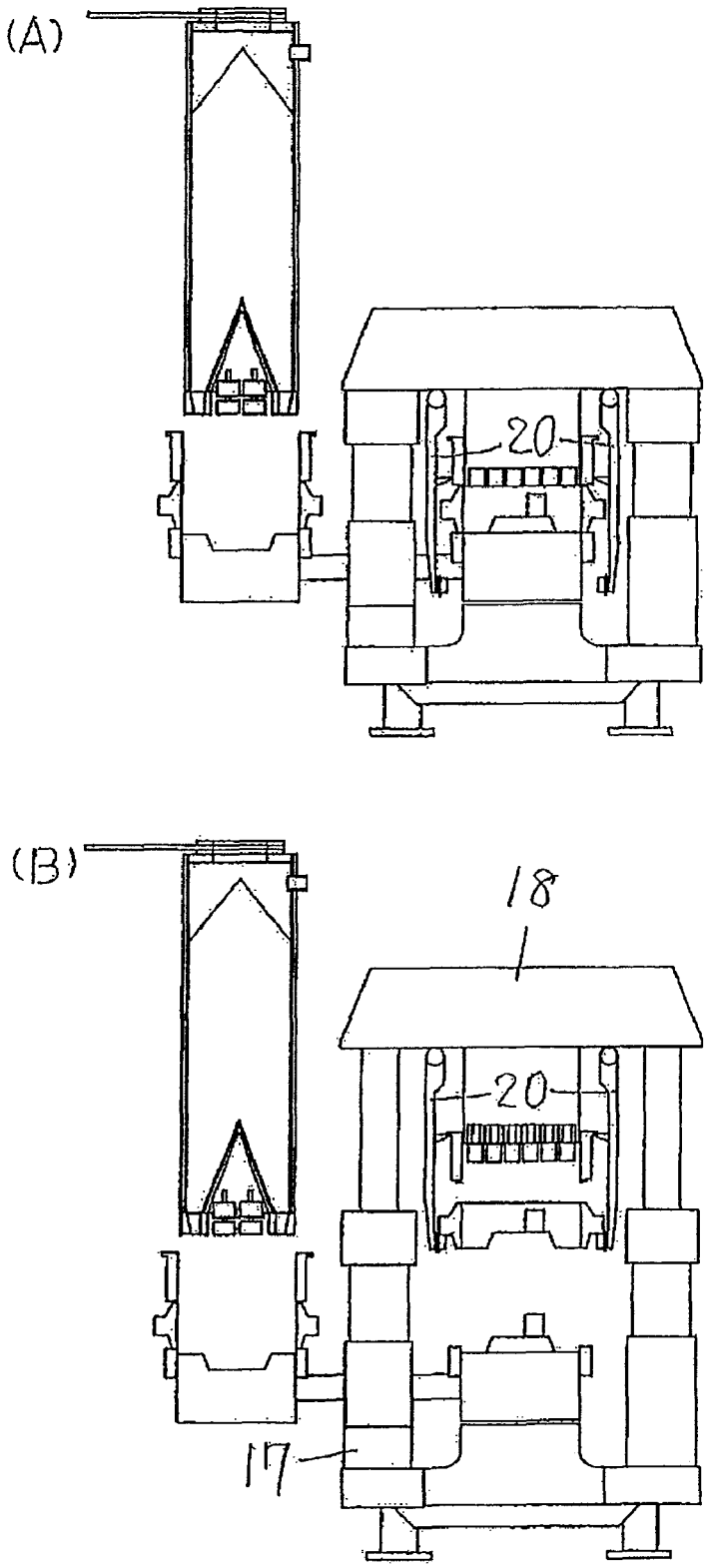
FIG. 8-A is an illustrative view of the equipment for molding a mold with a molding flask in operation of FIG. 1.

Next, as shown in FIG. 6-B, the plurality of squeezing feet 7, which is lowered by means of the ceiling frame 18 and advances into the filling frame 3, by the two hydraulic cylinders 17 being contracted, squeezes the molding sand in the molding flask 2 and the filling frame 3 above the upper model plate 1*a*, followed by the lifting of all the squeezing feet 7, as shown in FIG. 7-A. Next, as shown in FIG. 7-B, all the squeezing feet 7 are lowered by means of the ceiling frame 18, by the two hydraulic cylinders 17 being contracted, whereby the molding sand in the molding flask 2 and the filling frame 3 are squeezed, and then, as shown in FIG. 8-A, the distance between each frame of the pair of roller frames 20 is decreased. Then, as shown in FIG. 8-B, the upper mold with a molding flask is separated from the upper model plate 1*a*, by the pair of roller frames 20 being lifted via the ceiling frame 18 by the extension of two hydraulic cylinders 17, causing the pair of the hook members 22 and the pair of flanged rollers 21 to lift the molding flask 2 and the filling frame 3 respectively.

By repeating the process, the upper mold and the lower mold, each having a molding flask, are molded in turn.

Below another embodiment of the equipment for molding a mold with a molding flask of the present invention is explained in detail, based on FIGS. 9-14.

Figure 9:
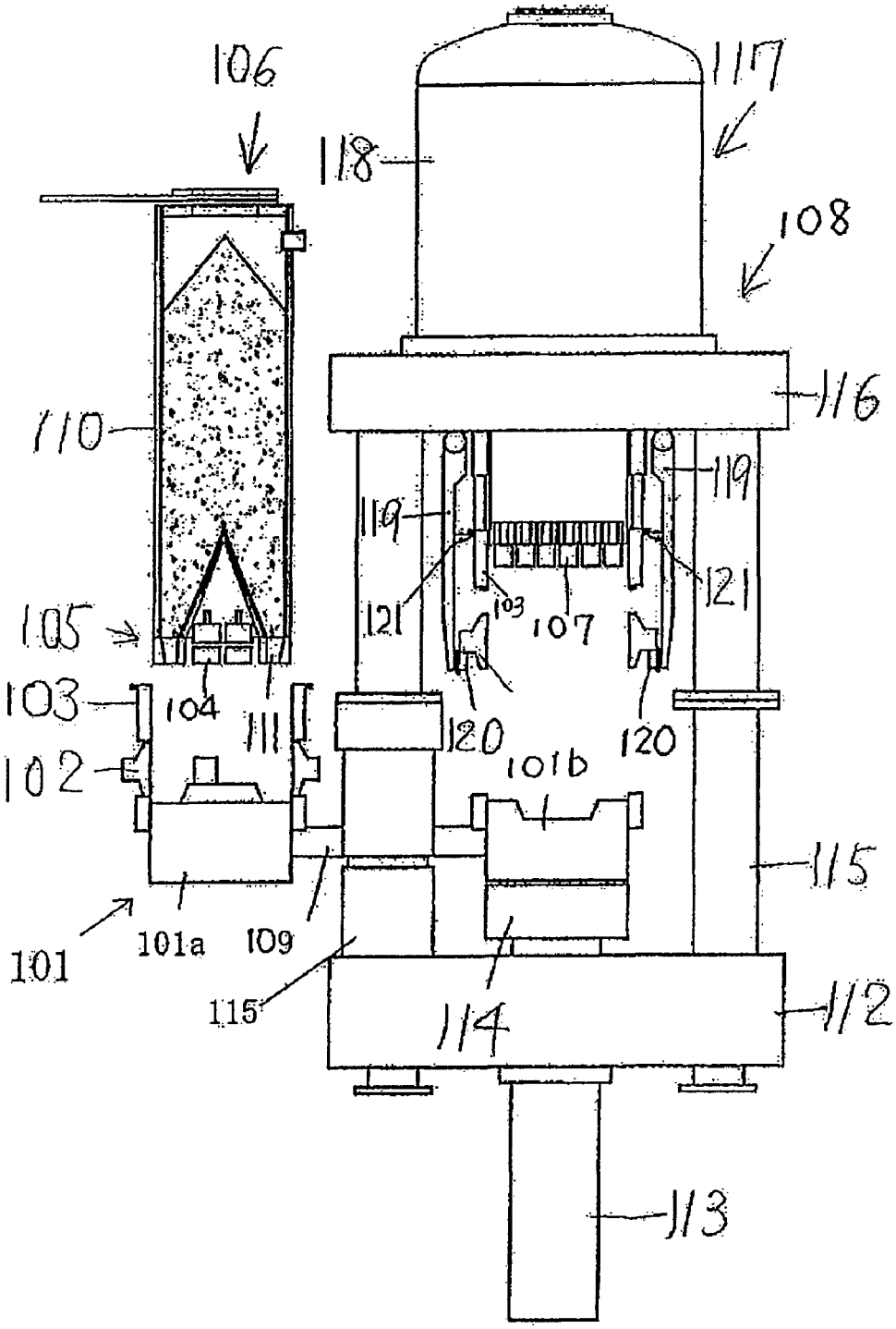
FIG. 9 is a part of the cross-section of the front view of equipment for molding a mold with a molding flask of another embodiment of the present invention.

As shown in FIG. 9, the equipment for molding a mold with a molding flask of the present invention comprises:

a means for introducing molding sand 106 that introduces molding sand into a molding flask 102 and a filling frame 103 using compressed air, the molding flask 102 and the filling frame 103 being mounted on a model plate 101 in a superimposed state, the means for introducing molding sand 106 comprising a shielding means 105 having a plurality of feet 104 that can enter the filling frame 103 and can be temporarily held individually at the positions that are spaced at the predetermined distances from the model part of the model plate 101, which model part faces the plurality of feet 104. The equipment further comprises a squeezing means 108 that has a plurality of squeezing feet 107, the squeezing means being provided adjacent to the means for introducing molding sand 106 and squeezes the molding sand in the molding flask 102 and the filling frame 103, and a turntable 109, as a transfer means, for carrying the model plate 101, the molding flask 102 and filling frame 103 into and out of both the means for introducing molding sand 106 and the squeezing means 108.

Then the means for introducing molding sand 106 is provided, within a sand tank 110 that stores the molding sand, with a means for fluidizing molding sand (not shown) that fluidizes the molding sand by injecting compressed air. Further, the sand tank 110 is installed on a carriage (not shown) that can move to the left and right. The sand tank 110 can be lifted and lowered by means of two cylinders (not shown). The sand tank 110 and the carriage, etc., can move into and out of the place right above a filling frame 103, which is explained later. Further, the lower part of the sand tank 110 has a shape that forks into two branches and each branch of the folk has an outlet 111 for discharging molding sand at the lowest end. Further, a plurality of feet 104 are provided between these two outlets 111 for discharging molding sand and can be lifted and lowered.

Also, as shown in FIG. 9, the squeezing means 108 has, at the middle of a base plate 112 a hydraulic cylinder 113 facing upward, which cylinders lift and lowers the model plate 101, the molding flask 102 and the filling frame 103. To the upper end of the piston rod of the hydraulic cylinder 113, is fastened a hoisting table 114 that can place the model plate 101 on it. Also, on the left and right sides of the base plate 112 are placed two support pillars 115, 115 in a standing position. Across the upper ends of the two support pillars 115, 115 is installed a ceiling frame 116. At the middle of and on the upper surface of the ceiling frame 116 is installed a mechanism for blowing compressed air 117 that pre-compresses the molding sand by injecting the compressed air. The mechanism for blowing compressed air 117 comprises, a pressure tank 118 that, together with the ceiling frame 116, constitutes a pressure vessel; a plurality of ventholes (not shown) provided at the ceiling frame 116 so as to penetrate it and communicate into the inner side of the pressure tank 118; and a valve means (not shown) that can open and close the plurality of the ventholes and that is provided within the pressure tank 118 in such a way that it can be lifted and lowered.

Further, a plurality of squeezing feet 107 is provided on the lower surface of and at the middle of the ceiling frame 116, which feet can each be lifted and lowered by a plurality of hydraulic cylinders (not shown)

On both left and right sides of a group of the plurality of squeezing feet 107, a pair of roller frames 119 that can extend in the backward and forward directions are suspended at their upper ends and spaced apart at a predetermined distance in the left and right directions. The pair of roller frames 119 are rotatably held at their upper ends, and the distance between each frame of the pair of roller frames 119 is widened and closed by the extension and contraction of a cylinder (not shown).

A plurality of flanged rollers 120, which can move backward and forward the molding flask 102 that is placed on the flanged rollers 120, is disposed at the lower ends of and the inner sides of a pair of roller frames 119. The plurality of flanged rollers 120 are supported at the axes of the rollers and positioned in a row in the backward and the forward directions space apart from each other at a predetermined distance. Further, hook members 121, on which the filling frame 103 is to be hooked, protrude at the inner sides of and at the upper parts of the pair of the roller frames 119.

Further, a turntable 109 is disposed at the left support pillar 115, wherein the turntable 109 can turn on the horizontal level at 180 degrees at certain intervals around the center of the turntable. The upper model plate 101*a* for molding the upper mold and the lower model plate 101*b* for molding the lower mold are loaded at the left side and right side ends of the turntable 109 respectively, so that they can be pushed up. The model plate 101 (the upper model plate 101*a* and the lower model plate 101*b*) is provided with a vent-plug (not shown) as a means for ventilation.

Figure 10:
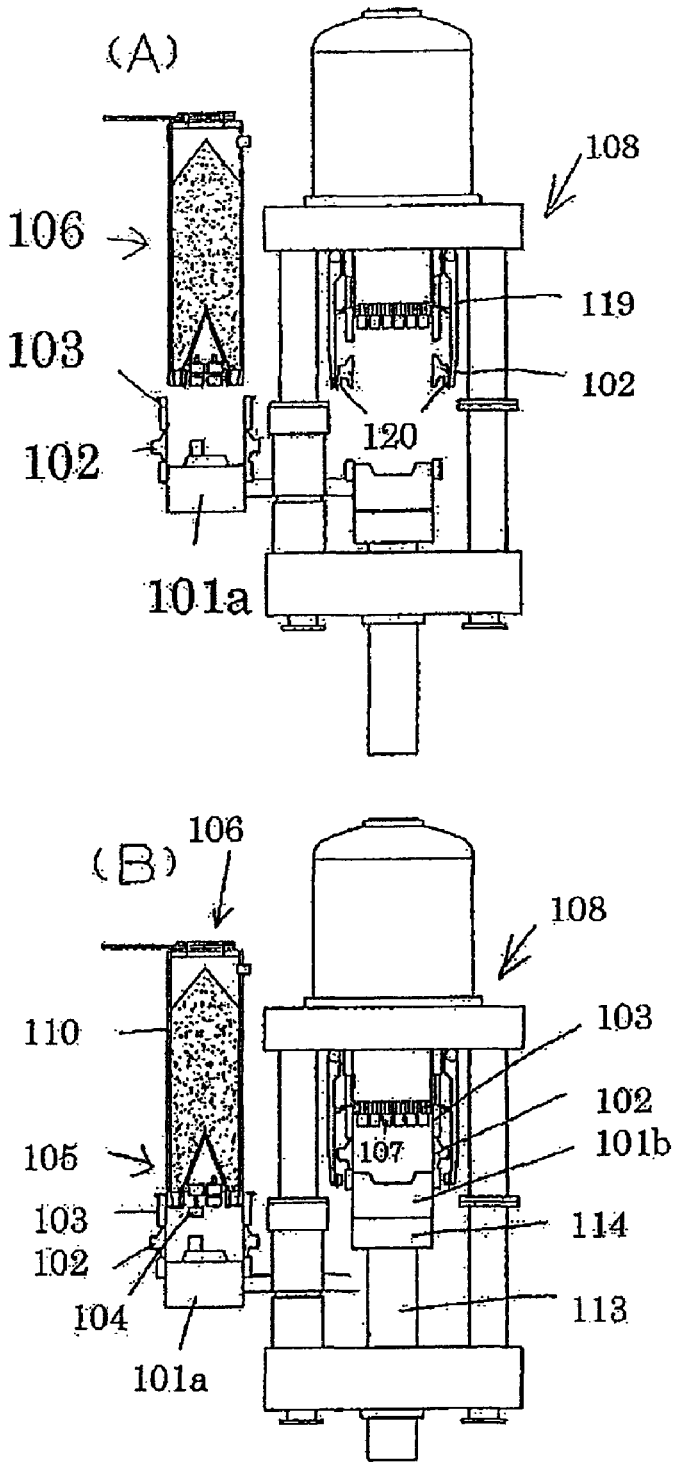
FIG. 10-A is an illustrative view of the equipment for molding a mold with a molding flask in operation of FIG. 9.

A process to mold a desired mold with a molding flask is explained, starting from the position that is shown in FIG. 9. First, as shown in FIG. 10-A, the means for introducing molding sand 106 is carried right above and close to the molding flask 102 and the filling frame 103 that are mounted on the upper model plate 101*a* in a superimposed state. An empty mold flask 102 is transferred onto the flanged rollers 120 of the pair of roller frames 119 of the squeezing means 108.

Next, as shown in FIG. 10-B, the sand tank 110 is lowered by means of cylinders of the means for introducing molding sand 106, and the plurality of feet 104 of the shielding means 105 is lifted and lowered corresponding to the shape of the model part of the upper model plate 101*a*, and also a plurality of feet 104 is advanced into the filling frame 103 that is above the upper model plate 101*a*. Namely, the plurality of feet 104 is lifted or lowered so that their lower surfaces keep the predetermined distances from the model part of the upper model plate 101*a*, which part faces the lower surfaces of the plurality of feet 104, thus forming the molding space by the upper model plate 101*a*, the molding flask 102 and the filling frame 103 and the plurality of feet 104.

In this case, the predetermined distances between the lower surfaces of the plurality of feet 104 and the model part of the upper model plate 101*a*, which model part faces the lower surfaces of the plurality of feet 104 are determined in such a way that where the height of the model part is greater the amount of sand that is compressed so as to mold a mold is made smaller by having the feet 104 lowered and where the height of the model part is smaller, the amount of sand that is compressed is increased with the relevant feet 104 being kept at a lifted position. In this way when the molding sand in the molding space is squeezed with the plurality of squeezing feet 107 of the squeezing means 108, the surfaces of all the squeezing feet 107 finally recede to nearly the same level as that of the surface of the molding flask 102.

In the squeezing means 108, as shown in FIG. 10-B, the molding flask 102 and the filling frame 103 are mounted on a lower model plate 101*b* of a hoisting table 114 in a superimposed state by the hoisting table 114 being hoisted by the extension of hydraulic cylinder 113.

Figure 11:
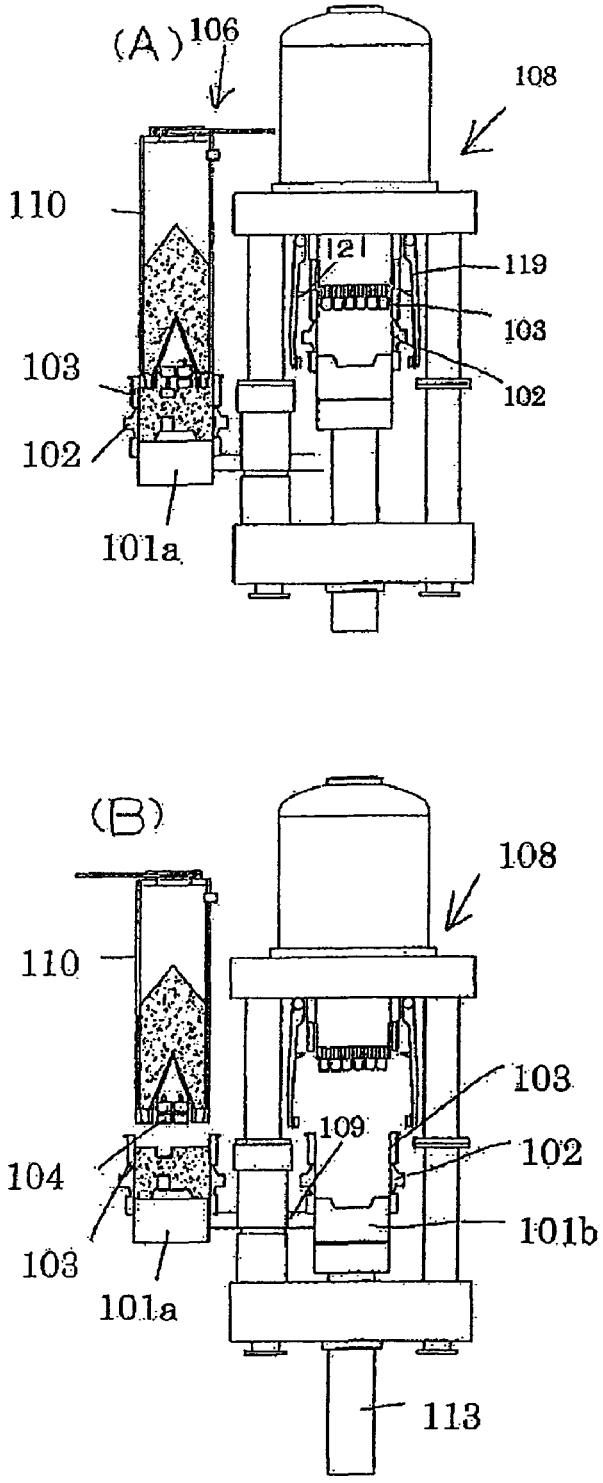
FIG. 11-A is an illustrative view of the equipment for molding a mold with a molding flask in operation of FIG. 9.

Then, as shown in FIG. 11-A, the facing sand is introduced onto the upper model plate 101*a*. Then, while the molding sand in the sand tank 110 is being fluidized by the compressed air that is injected from the means for fluidizing molding sand of the means for introducing molding sand 106, the molding sand is introduced into the molding flask 102 and the filling frame 103 that are above the upper model plate 101*a* by the compressed air being supplied to the upper surface of molding sand in the sand tank 110. The filling frame 103 is separated from two hook members 121 by the distance being increased between each frame of the pair of roller frames 119 of the squeezing means 108 and is placed on the molding flask 102.

Then, as shown in FIG. 11-B, the plurality of feet 104 is separated from the filling frame 103 that is above the upper model plate 101*a*, by the sand tank 110 being lifted by means of the hydraulic cylinders of the means for introducing molding sand 106, and then the plurality of feet 104 is further lifted. The lower model plate 101*b*, the molding flask 102 and the filling frame 103 are lowered by the contraction of the hydraulic cylinder 113 of the squeezing means 108 and then placed on the turntable 109.

Figure 12:
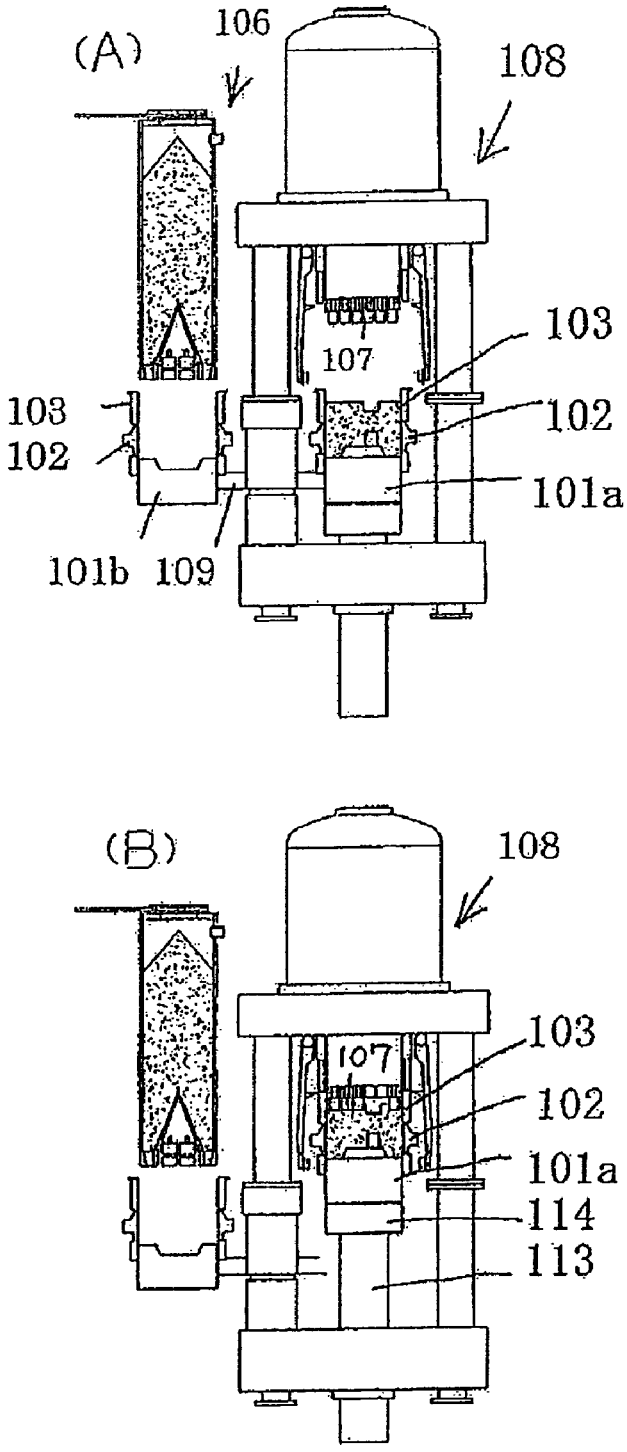
FIG. 12-A is an illustrative view of the equipment for molding a mold with a molding flask in operation of FIG. 9.

Next, as shown in FIG. 12-A, the upper model plate 101*a*, the molding flask 102 and the filling frame 103, etc., to which model plate, flask, and frame the molding sand is introduced, are transferred by the rotation of the turntable 109 from the position right below the means for introducing molding sand 106 to the position right below the plurality of squeezing feet 107 of the squeezing means 108. Also, the lower model plate 101*b*, the molding flask 102 and the filling frame 103, etc., are transferred by the rotation of the turntable 109 from the position right below the plurality of squeezing feet 107 to the position right below the means for introducing molding sand 106.

Next, as shown in FIG. 12-B, the upper model plate 101*a*, the molding flask 102 and the filling frame 103, etc., to which model plate, flask, and frame the molding sand is introduced, are lifted by the hoisting table 114 through the hydraulic cylinder 113 of the squeezing means 108 being extended, and the plurality of squeezing feet 107 are advanced into the filling frame 103.

Figure 13:
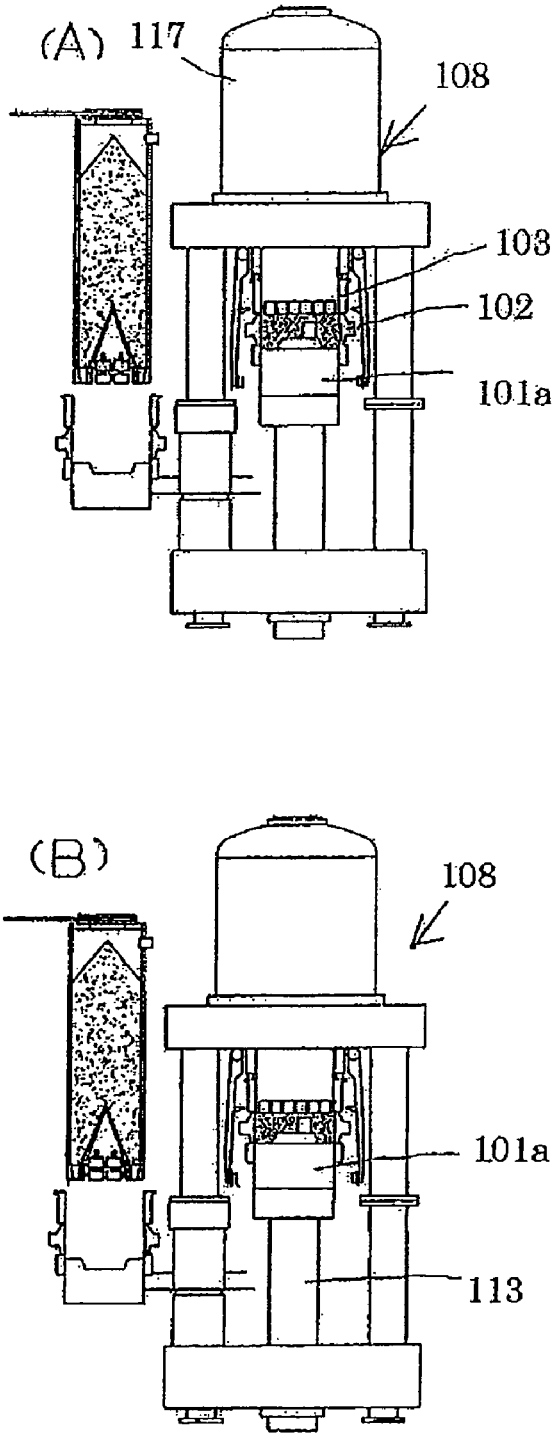
FIG. 13-A is an illustrative view of the equipment for molding a mold with a molding flask in operation of FIG. 9.

Next, as shown in FIG. 13-A, the molding sand within the space surrounded by the upper model plate 101*a*, the molding flask 102 and the filling frame 103, etc., is pre-compressed by the compressed air injected from a mechanism for blowing compressed air 117 of the squeezing means 108. Then, as shown in FIG. 13-B, the pre-compressed molding sand is squeezed by the upper model plate 101*a*, etc., being lifted by the hydraulic cylinder 113 of the squeezing means 108 further extended.

Figure 14:
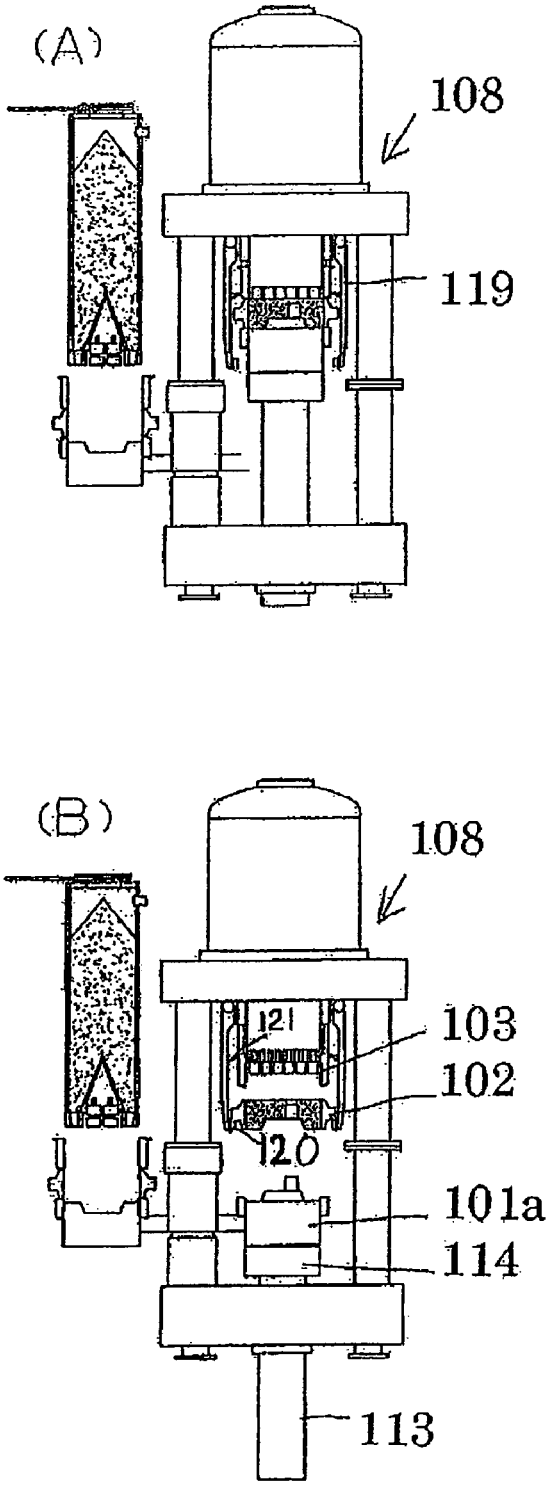
FIG. 14-A is an illustrative view of the equipment for molding a mold with a molding flask in operation of FIG. 9.

Next, as shown in FIG. 14-A, the distance between each frame of the pair of roller frames 119 of the squeezing means 108 is closed, followed by the lowering of the upper model plate 101*a*, the molding flask 102 and the filling frame 103, etc., by means of the hoisting table 114 being lowered through the contraction of the hydraulic cylinder 113, as shown in FIG. 14-B. Then the molding flask 102 containing the upper mold is separated from the upper model plate 101*a*, while the filling frame 103 and the molding flask 102 are hooked on a pair of hook members 121 and on the flanged rollers 120 respectively. In this way the upper mold with a molding flask can be molded. In the same way the lower mold having a molding flask can be molded. By repeating this operation the upper mold having a molding flask and the lower mold with a molding flask can be molded intermittently and in turn.

In the above embodiment the apparatuses as shown in FIG. 1 (example 1) and FIG. 9 (example 2) are employed as the squeezing means 8, 108. But an apparatus having any structure that has a function to squeeze molding sand that fills the molding flasks 2, 102 and the filling frames 3, 103 above the model plates 1, 101 can be used.

Also, in the above embodiment, the turntables 9, 109, are used as a transfer means. But the transfer means is not limited to the turntable of the embodiment. Any means that has a function to move the molding flasks 2, 102 and the filling frames 3, 103, mounted on the model plates 1, 101 in superimposed state, into and out of the means for introducing molding sand 6, 106 and the squeezing means 8, 108, in turn, such as a shuttle means, a means using a roller conveyor, can be used.

The present invention will become more fully understood from the detailed description of this specification. However, the detailed description and the specific embodiment illustrate desirable embodiments of the present invention and are described only for the purpose of explanation. Various changes and modifications will be apparent to those of ordinary skills in the art on the basis of the detailed description.

The applicant has no intention to dedicate to the public any disclosed embodiments. Among the disclosed changes and modifications, those that may not literally fall within the scope of the present claims constitute, therefore, a part of the present invention in the sense of the doctrine of equivalents.

The use of the articles "a," "an," and "the," and similar referents in the specification and claims, are to be construed to cover both the singular and the plural, unless otherwise indicated herein or clearly contradicted by the context. The use of any and all examples, or exemplary language (e.g., "such as," etc.) provided herein, is intended merely to better illuminate the invention and does not pose a limitation on the scope of the invention unless otherwise claimed.

The invention claimed is:

1. Equipment for molding a mold with a molding flask comprising:

means for introducing molding sand that introduces molding sand into a molding flask and a filling frame, using compressed air, the molding flask and the filling frame being mounted on a model plate in a superimposed state, wherein the means for introducing molding sand includes a shielding means having a plurality of feet that can enter the filling frame and can be temporarily held at positions that are spaced apart at predetermined distances from a model part of the model plate, which model part faces the plurality of feet;

squeezing means provided adjacent to the means for introducing molding sand, which squeezing means squeezes the molding sand in the molding flask and the filling frame; and transfer means for carrying the model plate, the molding flask and the filling frame into and out of both the means for introducing molding sand and the squeezing means.

2. The equipment for molding a mold with a molding flask of claim 1, wherein the means for introducing molding sand includes a means for fluidizing molding sand that fluidizes the molding sand by blowing compressed air.

3. The equipment for molding a mold with a molding flask of claim 1 or 2, wherein the squeezing means is provided with squeezing feet.

4. The equipment for molding a mold with a molding flask of claim 1 or 2, wherein the squeezing means is provided with a mechanism for blowing compressed air which mechanism blows the compressed air to pre-squeeze the molding sand.

5. The equipment for molding a mold with a molding flask of claim 1 or 2, wherein the model plate includes means for ventilation.

6. The equipment for molding a mold with a molding flask of claim 1 or 2, wherein the transfer means is a turntable.

7. A method for molding a mold with a molding flask using equipment for molding a mold with a molding flask having means for introducing molding sand that introduces molding sand into a molding flask and a filling frame, using compressed air, the molding flask and the filling frame being mounted on a model plate in a superimposed state, wherein the means for introducing molding sand includes a shielding means having a plurality of feet that can enter the filling frame and can be temporarily held at positions that are spaced apart at predetermined distances from a model part of the model plate, which model part faces the plurality of feet; squeezing means provided adjacent to the means for introducing molding sand, which squeezing means squeezes the molding sand in the molding flask and the filling frame; and transfer means for carrying the model plate, the molding flask and the filling frame into and out of both the means for introducing molding sand and the squeezing means, the method comprising the steps of:

introducing the molding sand into the molding flask and the filling frame, using the means for introducing molding sand, the molding flask and the filling frame being mounted on the model plate in a superimposed state; carrying by the transfer means the molding flask, the filling frame, and the model plate, into which model plate, flask, and frame the molding sand is introduced, to a position right below the squeezing means; and squeezing the molding sand in the molding flask and the filling frame by the squeezing means.

8. The method for molding a mold with a molding flask of claim 7, wherein the method further comprises the step of predetermining the distances between the plurality of feet of the shielding means and the model part of model plate by adjusting individually the heights of each of the plurality of the feet.

9. The method for molding a mold with a molding flask of claim 7, wherein the method further comprises the step of controlling individually the position of each of the feet of the shielding means by lifting and lowering each of the feet.

10. The method for molding a mold with a molding flask of any one of claims 7 to 9, wherein the molding sand is introduced into the molding flask and the filling frame above the model plate by the means for introducing molding sand, while the molding sand that was introduced into another set of the molding flask and the filling frame is squeezed by the squeezing means.

11. The method for molding a mold with a molding flask of any one of claims 7 to 9, wherein an auxiliary tool for molding a mold other than molding sand is placed on the model plate before molding sand is introduced into the molding flask and the filling frame.

12. The method for molding a mold with a molding flask of any one of claims 7 to 9, wherein facing sand is introduced into the molding flask before the molding sand is introduced into the molding flask and the filling frame.

13. The method for molding a mold with a molding flask of any one of claims 7 to 9, wherein the molding sand introduced into the molding flask and the filling frame by the means for introducing molding sand is pre-compressed by the means for introducing molding sand.

14. The method for molding a mold with a molding flask of any one of claims 7 to 9, wherein the plurality of feet of the shielding means are temporarily held at the positions that are spaced apart at the predetermined distances from the model part of the model plate, which model part faces the plurality of feet, and is pre-set before the squeezing means squeezes the molding sand introduced into the molding flask and the filling frame.

* * * * *